US008354362B2

(12) United States Patent
Price et al.

(10) Patent No.: US 8,354,362 B2
(45) Date of Patent: Jan. 15, 2013

(54) POLYMER AND LUBRICATING COMPOSITIONS THEREOF

(75) Inventors: David Price, Littleover (GB); William Barton, Belper (GB); Chor Huang, Avon, OH (US); Michael Sutton, Matlock (GB); Mark Davies, Belper (GB); Rodney J. McAtee, Southend Bradfield (GB); Mark F. Wilkes, Hatton (GB); Stephen J. Cook, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 751 days.

(21) Appl. No.: 12/294,096

(22) PCT Filed: Mar. 26, 2007

(86) PCT No.: PCT/US2007/064900

§ 371 (c)(1),
(2), (4) Date: Oct. 26, 2009

(87) PCT Pub. No.: WO2007/121039

PCT Pub. Date: Oct. 25, 2007

(65) Prior Publication Data

US 2010/0152082 A1 Jun. 17, 2010

Related U.S. Application Data

(60) Provisional application No. 60/743,806, filed on Mar. 27, 2006.

(51) Int. Cl.

| | |
|---|---|
| ***C10M 173/02*** | (2006.01) |
| ***C10M 145/14*** | (2006.01) |
| ***C10M 111/04*** | (2006.01) |

(52) U.S. Cl. ..... 508/508; 508/118; 508/469

(58) Field of Classification Search ..... 508/507, 508/508, 469, 118
See application file for complete search history.

(56) References Cited

U.S. PATENT DOCUMENTS

| | | | | |
|---|---|---|---|---|
| 4,033,888 | A | 7/1977 | Kiovsky | |
| 4,145,298 | A | 3/1979 | Trepka | |
| 5,429,758 | A | 7/1995 | Hayashi et al. | |
| 5,512,192 | A | 4/1996 | Lange et al. | |
| 5,753,778 | A * | 5/1998 | Ko et al. | 525/339 |
| 6,472,353 | B1 * | 10/2002 | Smoggie et al. | 508/221 |
| 2003/0096716 | A1 * | 5/2003 | Locke et al. | 508/525 |
| 2004/0121918 | A1 * | 6/2004 | Rea et al. | 508/291 |
| 2005/0003974 | A1 * | 1/2005 | Briggs et al. | 508/591 |
| 2005/0153849 | A1 | 7/2005 | Mishra et al. | |

FOREIGN PATENT DOCUMENTS

| | | | |
|---|---|---|---|
| EP | 0414343 | A1 | 2/1991 |
| EP | 0422728 | A1 | 4/1991 |
| EP | 1553115 | A2 | 1/2004 |

OTHER PUBLICATIONS

Search Report of corresponding PCT Publication No. WO 2007/121039A3 published Mar. 13, 2008.
Written Opinion of corresponding PCT Application No. PCT/US2007/064900 mailed Jan. 8, 2008.

* cited by examiner

*Primary Examiner* — Walter D Griffin
*Assistant Examiner* — Francis C Campanell
(74) *Attorney, Agent, or Firm* — David M. Shold; Christopher D. Hilker

(57) ABSTRACT

The invention provides a lubricating composition containing an oil of lubricating viscosity and a hydrogenated copolymer of an olefin block and vinyl aromatic block, wherein the copolymer is optionally functionalized. The invention further provides a method for preparing a hydrogenated copolymer; and the use of the lubricating composition.

7 Claims, No Drawings

POLYMER AND LUBRICATING COMPOSITIONS THEREOF

FIELD OF INVENTION

The present invention relates to a lubricating composition containing an oil of lubricating viscosity and a hydrogenated copolymer of an olefin block and vinyl aromatic block, wherein the copolymer is optionally functionalised. The invention further provides a method for preparing a hydrogenated copolymer, and the use of the lubricating composition.

BACKGROUND OF THE INVENTION

The use of polymers as viscosity modifiers (or viscosity index improvers) or dispersant viscosity modifiers in an oil of lubricating viscosity is well known. Typically polymer backbones include polymethacrylates, polyolefins or hydrogenated styrene-butadienes and functional derivatives thereof. For dispersant viscosity modifiers, the backbone may be functionalised with a grafted nitrogen compound.

Many of the known viscosity modifiers and dispersant viscosity modifiers have limited cleanliness performance and limited low temperature properties when the polymers degrade. This is often observed in engine piston deposits, particularly for olefin copolymers. Further, a number of viscosity modifiers and dispersant viscosity modifiers have limited low temperature performance.

Specifically for engine lubricants, limited cleanliness performance may result in ring stick or accumulation of deposits on valves or the tract. Deposit accumulation in valves may result in misting, air intake debris and valve stem seal leakage and cause other engine operation problems.

It is also further known that additives with long chain alkyl groups, such as polyisobutylene (commonly from succinimide dispersants), have a detrimental impact on fuel economy and cold crank. Therefore it would be a further advantage to reduce the amount of additives with a detrimental impact of fuel economy from engine oils.

In engine lubricants for marine diesel applications, due to limited supply of bright-stock, there is a need for an alternative material capable of providing a viscosity-modifying boost. Therefore, it would be a further advantage to identify a viscosity modifier capable of replacing brightstock.

U.S. Pat. No. 5,512,192 discloses a dispersant viscosity improver for lubricating oil compositions prepared by the reaction of an oil soluble, substantially hydrogenated, vinyl substituted aromatic-aliphatic conjugated diene block copolymer, grafted with an ethylenically unsaturated carboxylic acid or functional derivative thereof. The dispersant viscosity improver typically has a number average molecular weight of 30,000 to 300,000; and a weight average molecular weight of 50,000 to 500,000.

U.S. Pat. No. 5,429,758 discloses graft copolymers prepared from solvent free reactions and dispersant derivatives thereof. The graft copolymers include a hydrogenated random or normal block copolymer made from a vinyl substituted aromatic monomer and a conjugated diene. The normal and random block copolymer has a number average molecular weight from 10,000 to 500,000.

US Patent Application 2005/0153849 discloses grafting a polymer backbone selected from olefin polymers, diene polymers, vinyl polymers and vinylidene polymers, which have been further reacted with a variety of amines.

The present invention provides a copolymer capable of being used as viscosity modifiers and/or dispersant viscosity modifiers capable of providing at least one of acceptable low temperature performance and/or cleanliness. When the lubricant composition is suitable for engine oils, the invention further provides at least one of acceptable fuel economy, whilst maintaining cleanliness, and soot and sludge handling.

SUMMARY OF THE INVENTION

As used herein the phrase 'mole ratio of block A/(block A+B)' means the ratio of the moles of repeat units (or monomer units) in block A divided by the sum of repeat units in (block A+block B).

The present invention in one embodiment provides a lubricating composition comprising: an oil of lubricating viscosity and a hydrogenated copolymer comprising at least one olefin polymer block (block A) and at least one vinyl aromatic polymer block (block B) with mole ratio of block A/(block A+B) of 0.5 to 0.9, wherein block A contains repeat units with 5 mol % to 95 mol % of branched alkyl groups, with the proviso that when the copolymer comprises a tapered copolymer, block A contains repeat units with greater than 38.5 mol % to 95 mol % of branched alkyl groups, wherein the branched alkyl groups of block A are optionally further substituted; and wherein the hydrogenated copolymer is optionally further functionalised by at least one of the following routes:

(i) block A or block B being further functionalised with a pendant carbonyl containing group, and wherein the pendant carbonyl containing group is optionally further substituted to provide an ester, amine, imide or amide functionality, and/or (ii) block A being further functionalised with an amine functionality bonded directly onto the olefin block polymer.

The present invention in one embodiment provides a lubricating composition comprising: an oil of lubricating viscosity and a hydrogenated copolymer other than a tapered copolymer, wherein the hydrogenated copolymer comprises at least one olefin polymer block (block A) and at least one vinyl aromatic polymer block (block B) with mole ratio of block A/(block A+B) of 0.5 to 0.9, wherein block A contains repeat units with 5 mol % to 95 mol % of branched alkyl groups, wherein the branched alkyl groups of block A are optionally further substituted; and wherein the hydrogenated copolymer is optionally further functionalised by at least one of the following routes:

(i) block A or block B being further functionalised with a pendant carbonyl containing group, and wherein the pendant carbonyl containing group is optionally further substituted to provide an ester, amine, imide or amide functionality, and/or (ii) block A being further functionalised with an amine functionality bonded directly onto the olefin block polymer.

The present invention in one embodiment provides a lubricating composition comprising: an oil of lubricating viscosity and a hydrogenated tapered copolymer, wherein the hydrogenated tapered copolymer comprises at least one olefin polymer block (block A) and at least one vinyl aromatic polymer block (block B) with mole ratio of block A/(block A+B) of 0.5 to 0.9, wherein block A contains repeat units with greater than 38.5 mol % to 95 mol % of branched alkyl groups, wherein the branched alkyl groups of block A are optionally further substituted; and wherein the hydrogenated copolymer is optionally further functionalised by at least one of the following routes:

(i) block A or block B being further functionalised with a pendant carbonyl containing group, and wherein the pendant carbonyl containing group is optionally further substituted to provide an ester, amine, imide or amide functionality, and/or (ii) block A being further functionalised with an amine functionality bonded directly onto the olefin block polymer.

In one embodiment the invention provides a lubricating composition comprising: an oil of lubricating viscosity and a hydrogenated copolymer comprising block A and block B represented by the formulae:

Block (A)

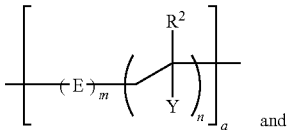

and

Block (B)

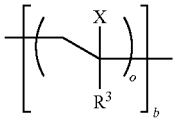

wherein a and b are coefficients for their corresponding monomer repeat units, wherein the ratio of a/(a+b) is 0.5 to 0.9, or 0.55 to 0.8, or 0.6 to 0.75;

$R^2$ is H, alkyl, or alkyl-Z, with the proviso that 5 mol % to 95 mol % of the $R^2$ groups are alkyl or alkyl-Z groups (in one embodiment, $R^2$ is not H);

$R^3$ is an arene group or an alkyl-substituted arene group optionally further functionalised with a pendant carbonyl-containing group;

E is an alkylene group or an alkenylene group (typically E is a $C_4$ group);

X, Y and Z are independently H or pendant carbonyl-containing groups, with the proviso that at least one of X, Y and Z is a pendant carbonyl-containing group; and m, n, and o are numbers of repeat units for the moieties described above, with the proviso that each repeat unit is present in sufficient quantities to provide the polymer with an appropriate number average molecular weight, and wherein the polymer is terminated with a polymerisation terminating group, and with the proviso that when the copolymer comprises a tapered copolymer block, A contains repeat units with greater than 38.5 mol % to 95 mol % of branched, optionally substituted alkyl groups.

In one embodiment the invention provides a lubricating composition comprising: an oil of lubricating viscosity and a hydrogenated copolymer containing blocks A and B as above, represented by the formula:

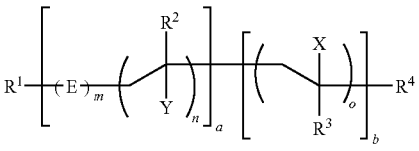

wherein a and b are coefficients for their corresponding monomer repeat units, wherein the ratio of a/(a+b) is 0.5 to 0.9, or 0.55 to 0.8, or 0.6 to 0.75;

$R^1$ is H, t-alkyl, sec-alkyl, $CH_3$—, $R'_2N$—, or aryl;

$R^2$ is H, alkyl or alkyl-Z, with the proviso that in block (A) 5 mol % to 95 mol % of the $R^2$ groups are alkyl or -alkyl-Z groups;

$R^3$ is an arene group or an alkyl-substituted arene group optionally further functionalised with a pendant carbonyl-containing group;

$R^4$ is a polymerising terminating group, such as H or alkyl;

E is an alkylene group or an alkenylene group (typically E is a $C_4$ group);

X, Y and Z are independently H or a carbonyl-containing group, with the proviso that at least one of X, Y and Z is a pendant carbonyl-containing group;

R' is a hydrocarbyl group, and m, n, and o are numbers of repeat units for the moieties described above, with the proviso that each repeat unit is present in sufficient quantities to provide the hydrogenated copolymer with an appropriate number average molecular weight, and with the proviso that when the copolymer comprises a tapered copolymer, block A contains repeat units with greater than 38.5 mol % to 95 mol % of branched, optionally substituted alkyl groups.

In one embodiment the invention provides a lubricating composition comprising (I) an oil of lubricating viscosity and (II) a hydrogenated copolymer obtainable/obtained by the process comprising:

(a) polymerising (i) a vinyl aromatic polymer block and (ii) an olefin polymer block, wherein the olefin polymer block reacts by 1,2-addition to give 5 mol % to 95 mol % of branched, optionally substituted alkyl groups in the olefin polymer block, followed by one or more of steps (b) to (d);

(b) optionally hydrogenating the product of step (a);

(c) optionally either (c1) reacting, under free radical grafting conditions (in processes well known to a person skilled in the art of polymer science e.g., solution phase and/or melt processes i.e. extrusion grafting), a carbonyl containing compound, with the polymer from step (b) to form a polymer with a pendant carbonyl containing group, or (c2) reacting, under thermal grafting conditions, a carbonyl containing compound with the polymer from step (a) to form a polymer with a pendant carbonyl containing group, followed by optionally hydrogenating the polymer of (c2);

(d) optionally reacting the carbonyl containing polymer of step (c1) and/or (c2) with at least one of an alcohol and/or an amine (typically forming an ester, an amide or an imide) to form a functionalised polymer, with the proviso that when the copolymer comprises a tapered copolymer, block A contains repeat units with greater than 38.5 mol % to 95 mol % of branched, optionally substituted alkyl groups; and (e) optionally reacting the copolymer with a pendant carbonyl-containing group with at least one of an alcohol and/or an amine, to form a functionalised polymer, with the proviso that when the copolymer comprises a tapered copolymer, block A contains repeat units with greater than 38.5 mol % to 95 mol % of branched, optionally substituted alkyl groups.

In one embodiment the invention provides a lubricating composition comprising an oil of lubricating viscosity, a hydrogenated copolymer as disclosed herein and at least one additive including a dispersant, an antioxidant, an antiwear agent, a friction modifier or mixtures thereof.

In one embodiment the lubricating composition comprises an oil of lubricating viscosity, a hydrogenated copolymer as disclosed herein and a dispersant, or mixtures thereof.

In one embodiment the lubricating composition comprises an oil of lubricating viscosity, a hydrogenated copolymer as disclosed herein and an antioxidant, or mixtures thereof.

In one embodiment the lubricating composition comprises an oil of lubricating viscosity, a hydrogenated copolymer as disclosed herein and an anti wear agent, or mixtures thereof.

In one embodiment the lubricating composition comprises an oil of lubricating viscosity, a hydrogenated copolymer as disclosed herein and a friction modifier, or mixtures thereof.

In one embodiment the lubricant composition as described herein for an internal combustion engine has reduced amounts of at least one of sulphur, phosphorus and sulphated ash.

In one embodiment the invention provides for the use of the lubricating composition in an engine oil for a 2-stroke or a 4-stroke internal combustion engine, a gear oil, an automatic transmission oil, a hydraulic fluid, a turbine oil, a metal working fluid, or a circulating oil.

DETAILED DESCRIPTION OF THE INVENTION

Hydrogenated Copolymer

The present invention provides a hydrogenated copolymer and lubricating compositions as disclosed above.

As used herein the phrase 'branched alkyl groups' includes branched alkyl groups that are optionally further substituted. As otherwise stated, alkyl branches on the polymer chain may or may not themselves be further branched.

In different embodiments the hydrogenated copolymer is typically hydrogenated at 50% to 100%, or 90% to 100% or 95% to 100% of available double bonds (which does not normally include aromatic unsaturation).

In one embodiment block A may be derived from a diene or mixtures thereof. A suitable diene used to generate the block represented by A includes 1,4-butadiene or isoprene. In one embodiment the diene is 1,4-butadiene. In one embodiment block A is substantially free of, to free of, isoprene.

As used herein the term "substantially free of isoprene" means the polymer contains isoprene at not more than impurity levels, typically, less than 1 mol % of the polymer, or 0.05 mol % or less of the polymer, or 0.01 mol % or less of the polymer, or 0 mol % of the polymer.

The diene typically polymerises by either 1,2-addition or 1,4-addition. In the present invention the degree of 1,2-addition is an important feature and is defined by the relative amounts of repeat units of branched alkyl groups (also defined herein as $R^2$). Any initially-formed pendant unsaturated or vinyl groups, upon hydrogenation, become alkyl branches ("branched alkyl groups").

In different embodiments block A (when not in a tapered copolymer) contains 20 mol % to 80 mol %, or 25 mol % to 75 mol %, or 30 mol % to 70 mol %, or 40 mol % to 65 mol % of repeat units of branched alkyl groups.

A tapered copolymer, may contain 40 mol % to 80 mol %, or 50 mol % to 75 mol % of block A containing repeat units of branched alkyl groups (or vinyl groups).

In one embodiment the polymer of the invention may be prepared by anionic polymerisation techniques. As a person skilled in the art will appreciate, it is believed that anionic polymerisation initiators containing alkali metals and/or organometallic compounds are sensitive to interactions between the various metals and the counterion and/or solvent. In order to prepare a polymer with increasing amounts of diene polymerised with a larger amount of 1,2-addition, it is typical to employ a polar solvent (for example tetrahydrofuran). Further employing an initiator with a lower atomic mass is suitable (for example use lithium rather than cesium). In different embodiments butyl lithium or butyl sodium may be used as initiators. Typical anionic polymerisation temperatures such as below 0° C., or −20° C. or less may be employed. A more detailed description of methods suitable for preparing a polymer with a greater amounts of diene 1,2-addition stereospecificity is found in Kirk-Othmer Encyclopedia of Chemical Technology, Third Edition, Volume 4, pages 316-317 or in Anionic Polymerisation, Principles and Practical Applications, Edited by Henry L. Hsieh and Roderic P. Quirk, pages 209 and 217, 1996, Marcel Dekker.

In different embodiments, the olefin polymer block may also be formed with a large amount of 1,2-addition (i.e. 5 mol % to 95 mol % of branched groups) by employing the processes or methods described in U.S. Pat. No. 5,753,778 (discloses in column 3, lines 1 to 33 a process using an alkyllithium initiator for selectively hydrogenating a polymer); U.S. Pat. No. 5,910,566 (discloses in column 3, lines 13 to 43 a suitable process, solvent and catalyst for hydrogenating a conjugated diene); U.S. Pat. No. 5,994,477 (discloses in column 3, line 24 to column 4, line 32 a method for selectively hydrogenating a polymer); U.S. Pat. No. 6,020,439 (column 3, lines 30-52 discloses a suitable catalyst); and U.S. Pat. No. 6,040,390 (discloses in column 9, lines 2-17 a suitable catalyst). Typically the amount of 1,2-addition disclosed in the Examples of these patents range from 30 to 42% of the butadiene units).

Suitable vinyl aromatic monomers include styrene or alkylstyrene (e.g. alpha-methylstyrene, para-tert-butylstyrene, alpha-ethylstyrene, and para-lower alkoxy styrene). In one embodiment the vinyl aromatic monomer is styrene.

The vinyl aromatic monomers (e.g. a substituted styrene) may often be functionalised with a group including acyl groups or halo-, alkoxy-, carboxy, hydroxy-, sulphonyl-, nitro-, nitroso-, and hydrocarbyl-substituents wherein the hydrocarbyl group typically has 1 to 12 carbon atoms.

The acyl group may be incorporated into the vinyl aromatic block under thermal grafting conditions, optionally in the presence of a Lewis acid. Suitable Lewis acid catalysts are known in the art and include $BF_3$ and complexes thereof, $AlCl_3$, $TiCl_4$, or $SnCl_2$. Complexes of $BF_3$ include boron trifluoride etherate, boron trifluoride-phenol and boron trifluoride-phosphoric acid.

Thermal grafting conditions are known in the art and include a reaction temperature of 0° C. to 150° C., or 10° C. to 120° C.

The pendant carbonyl-containing group may be derived from alkyl acid halides (typically chlorides), alkyl anhydrides or alkyl-substituted monocarboxylic acids or derivatives thereof. In different embodiments the alkyl group contains 6 to 100, or 8 to 80 or 8 to 50 carbon atoms. Examples of a suitable alkyl group include polyisobutylene, linear or branched dodecyl, tetradecyl or hexadecyl.

The weight average molecular weight of the hydrogenated copolymer typically ranges from 1000 to 1,000,000, or 5,000 to 500,000, or 10,000 to 250,000, or 50,000 to 175,000.

In different embodiments the polydispersity of the hydrogenated polymer typically ranges from 1 to less than 1.6, or 1 to 1.55, or 1 to 1.4, or 1.01 to 1.2.

In one embodiment the polymer of the invention comprises a backbone derived from 5 to 70 mol %, or 10 mol % to 60 mol %, or 20 mol % to 60 mol % of the alkenylarene monomer e.g., styrene.

In one embodiment the polymer of the invention comprises a backbone derived from 30 to 95 mol %, or 40 mol % to 90 mol %, or 40 mol % to 80 mol % of an olefin monomer e.g., butadiene.

In one embodiment the polymer of the invention is a block copolymer and includes regular, random, tapered or alternating architectures. The block copolymer may be either a di-block AB copolymer, or a tri-block ABA copolymer. Often the polymer is a di-block AB copolymer. In one embodiment the polymer is other than a tapered copolymer.

In one embodiment the pendant carbonyl-containing group is present on X or Y as disclosed by the Formulae Block (A) and Block (B) defined above.

The X and Y groups may be grafted onto the polymer backbone under free radical conditions. The free radical conditions are known and include a reaction temperature of 20° C. to 200° C., or 60° C. to 160° C.

Alternatively, the invention may be disclosed by the formulae Block (A) and Block (B) defined above.

The $R^2$ group, containing alkyl or -alkyl-Z groups, may also be defined as a vinyl group prior to hydrogenation. The 1,2-addition produces a vinyl group or branching group. The number of carbons present on an unsubstituted $R^2$ may be from 1 to 8, or 1 to 4, or about 2. When $R^2$ is further substituted, e.g., with a pendant carbonyl containing group, the number of carbon atoms on $R^2$ increases by the number of carbon atoms present in the pendant carbonyl containing group.

The Z group of the -alkyl-Z and/or the Y group may be grafted onto the vinyl or branched group or backbone under ene-reaction conditions.

The ene-reaction conditions are known and include a reaction temperature of 60° C. to 220° C., or 100° C. to 200° C.

$R^3$ may be derived from vinyl aromatic monomers, or mixtures thereof. In one embodiment $R^3$ may be substituted styrene.

In different embodiments the hydrogenated copolymer may be a sequential block, random block or regular block copolymer. In one embodiment the hydrogenated copolymer is sequential block copolymer.

As used herein the term 'sequential block copolymer' means that the copolymer consists of discrete blocks (A and B), each made up of a single monomer. Examples include of a sequential block copolymer include those with A-B or B-A-B architecture.

In different embodiments the hydrogenated copolymer may be a linear, a branched or a star copolymer.

In one embodiment the hydrogenated copolymer is a linear copolymer.

In one embodiment the hydrogenated copolymer is a star copolymer.

In different embodiments the hydrogenated copolymer is either a diblock sequential block copolymer, or a diblock normal diblock star copolymer.

In one embodiment the hydrogenated copolymer is not a triblock or higher block copolymer.

In one embodiment the polymer comprises a backbone of styrene and 1,3-butadiene. Commercially available copolymers of styrene and butadiene (i.e. an unfunctionalised copolymer with X, Y and Z groups defined as hydrogen from formulae above) with 5 mol % to 95 mol % of butadiene reacted by 1,2-addition include Lubrizol®7408A.

Pendant Carbonyl-Containing Group

The pendant carbonyl-containing group may be represented by a carboxylic acid or derivatives thereof, such as an amide- or imide-containing group. The carboxylic acid or derivatives thereof includes anhydrides, acyl halides, or lower alkyl esters thereof, amides, ketones, aldehydes and imides. Mixtures of such materials can also be used. These include mono-carboxylic acids (e.g., acrylic acid and methacrylic acid) and esters, e.g., lower alkyl esters thereof, as well as dicarboxylic acids, anhydrides and esters, e.g., lower alkyl esters thereof. Examples of dicarboxylic acids, anhydrides and esters include maleic acid or anhydride, fumaric acid, or ester, such as lower alkyl, i.e., those containing no more than 7 carbon atoms on the alkyl ester group.

In one embodiment the dicarboxylic acids, anhydrides and esters may be represented by the groups of formulae:

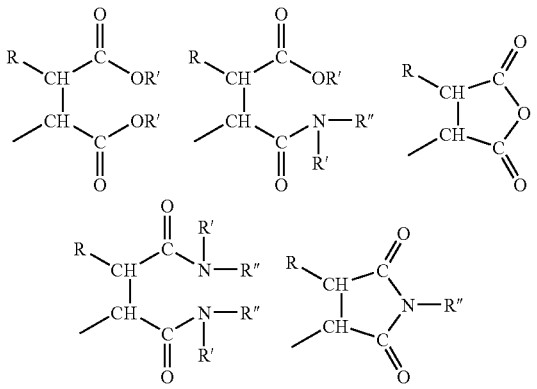

R is hydrogen or hydrocarbyl of up to 8 carbon atoms, such as alkyl, alkaryl or aryl. Each R' is independently hydrogen or hydrocarbyl, for instance, lower alkyl of up to 7 carbon atoms (e.g., methyl, ethyl, butyl or heptyl). R" may be independently aromatic (mononuclear or fused polynuclear) hydrocarbon, representative of an aromatic amine or polyamine as described below. The dicarboxylic acids, anhydrides or alkyl esters thereof typically contain up to 25 carbon atoms total, or up to 15 carbon atoms. Examples include maleic acid or anhydride, or succinimide derivatives thereof; benzyl maleic anhydride; chloro maleic anhydride; heptyl maleate; itaconic acid or anhydride; citraconic acid or anhydride; ethyl fumarate; fumaric acid; mesaconic acid; ethyl isopropyl maleate; isopropyl fumarate; hexyl methyl maleate; and phenyl maleic anhydride. Maleic anhydride, maleic acid and fumaric acid and the lower alkyl esters thereof are often used.

Alcohol-Functionalised Polymer

In one embodiment the polymer of the invention further comprises an ester group, typically from the reaction of the carbonyl-containing functional group with an alcohol. Suitable alcohols may contain 1 to 40 or 6 to 30 carbon atoms.

Examples of suitable alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

Nitrogen-Functionalised Polymer

In one embodiment the polymer of the invention further comprises a nitrogen-containing group. In one embodiment the polymer may be further reacted/grafted with a nitrogen-containing group to form a functionalised polymer containing an amine, amide or imide group. Typically the nitrogen-containing group reacts with the pendant carbonyl-containing group. Suitable amines include aliphatic, aromatic or non-aromatic amines.

The amine functional group may be (i) bonded to a pendant carbonyl containing group, e.g., a carboxylic acid to form an imide or amide functionality, or (ii) the amine may be bonded directly onto the olefin block polymer (block A).

In different embodiments the amine functional group may be derived from a nitrogen-containing monomer, and/or an amine with a primary and/or secondary nitrogen.

Examples of suitable nitrogen-containing monomers include (meth)acrylamide or a nitrogen containing (meth) acrylate monomer (where "(meth)acrylate" or "(meth)acrylamide" represents both the acrylic or methacrylic materials). Typically the nitrogen-containing compound comprises a (meth)acrylamide or nitrogen containing (meth)acrylate monomer and may be represented by the formula:

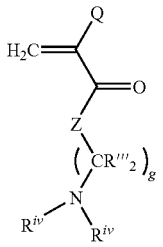

wherein

Q is hydrogen or methyl and, in one embodiment, Q is methyl;

Z is an N—H group or O (oxygen);

each R''' is independently hydrogen or a hydrocarbyl group containing 1 to 2 carbon atoms and, in one embodiment, each R''' is hydrogen;

each $R^{iv}$ is independently hydrogen or a hydrocarbyl group containing 1 to 8 or 1 to 4 carbon atoms; and g is an integer from 1 to 6 and, in one embodiment, g is 1 to 3.

Examples of suitable nitrogen-containing monomers include N,N-dimethylacrylamide, N-vinyl carbonamides (such as, N-vinyl-formamide, N-vinylacetoamide, N-vinyl-n-propionamides, N-vinyl-i-propionamides, N-vinyl hydroxyacetoamide, vinyl pyridine, N-vinyl imidazole, N-vinyl pyrrolidinone, N-vinyl caprolactam, dimethylaminoethyl acrylate, dimethylaminoethylmethacrylate, dimethylaminobutylacrylamide, dimethylamine propyl methacrylate, dimethylaminopropylacrylamide, dimethylaminopropylmethacrylamide, dimethylaminoethylacrylamide or mixtures thereof.

In one embodiment the amine is aromatic. Aromatic amines include those which can be represented by the general structure $NH_2$—Ar or T-NH—Ar, where T may be alkyl or aromatic, Ar is an aromatic group, including nitrogen-containing aromatic groups and Ar groups including any of the following structures:

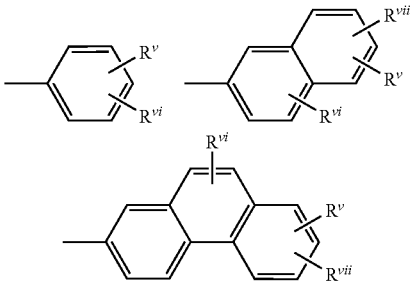

as well as multiple non-condensed or linked aromatic rings. In these and related structures, $R^{v}$, $R^{vi}$, and $R^{vii}$ can be independently, among other groups disclosed herein, —H, —$C_{1-18}$ alkyl groups, nitro groups, —NH—Ar, —N=N—Ar, —NH—CO—Ar, —OOC—Ar, —OOC—$C_{1-18}$ alkyl, —COO—$C_{1-18}$ alkyl, —OH, —O—$(CH_2CH_2—O)_nC_{1-18}$ alkyl groups, and —O—$(CH_2CH_2O)_nAr$ (where n is 0 to 10).

Aromatic amines include those amines wherein a carbon atom of the aromatic ring structure is attached directly to the amino nitrogen. The amines may be monoamines or polyamines. The aromatic ring will typically be a mononuclear aromatic ring (i.e., one derived from benzene) but can include fused aromatic rings, especially those derived from naphthalene. Examples of aromatic amines include aniline, N-alkylanilines such as N-methylaniline and N-butylaniline, di-(para-methylphenyl)amine, 4-aminodiphenylamine, N,N-dimethylphenylenediamine, naphthylamine, 4-(4-nitrophenylazo)aniline (disperse orange 3), sulfamethazine, 4-phenoxyaniline, 3-nitroaniline, 4-aminoacetanilide (N-(4-aminophenyl)acetamide)), 4-amino-2-hydroxy-benzoic acid phenyl ester (phenyl amino salicylate), N-(4-amino-phenyl)-benzamide, various benzylamines such as 2,5-dimethoxybenzylamine, 4-phenylazoaniline, and substituted versions of these. Other examples include para-ethoxyaniline, para-dodecylaniline, cyclohexyl-substituted naphthylamine, and thienyl-substituted aniline. Examples of other suitable aromatic amines include amino-substituted aromatic compounds and amines in which the amine nitrogen is a part of an aromatic ring, such as 3-aminoquinoline, 5-aminoquinoline, and 8-aminoquinoline. Also included are aromatic amines such as 2-aminobenzimidazole, which contains one secondary amino group attached directly to the aromatic ring and a primary amino group attached to the imidazole ring. Other amines include N-(4-anilinophenyl)-3-aminobutanamide or 3-amino propyl imidazole. Yet other amines include 2,5-dimethoxybenzylamine Additional aromatic amines and related compounds are disclosed in U.S. Pat. Nos. 6,107,257 and 6,107,258; some of these include aminocarbazoles, benzoimidazoles, aminoindoles, aminopyrroles, amino-indazolinones, aminoperimidines, mercaptotriazoles, aminophenothiazines, aminopyridines, aminopyrazines, aminopyrimidines, pyridines, pyrazines, pyrimidines, aminothiadiazoles, aminothiothiadiazoles, and aminobenzotriaozles. Other suitable amines include 3-amino-N-(4-anilinophenyl)-N-isopropyl butanamide, and N-(4-anilinophenyl)-3-{(3-aminopropyl)-(cocoalkyl)amino}butanamide. Other aromatic amines which can be used include various aromatic amine dye intermediates containing multiple aromatic rings linked by, for example, amide structures. Examples include materials of the general structure

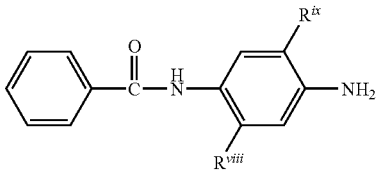

and isomeric variations thereof, where $R^{viii}$ and $R^{ix}$ are independently alkyl or alkoxy groups such as methyl, methoxy, or ethoxy. In one instance, $R^{viii}$ and $R^{ix}$ are both —$OCH_3$ and the material is known as Fast Blue RR [CAS# 6268-05-9].

In another instance, $R^{ix}$ is —$OCH_3$ and $R^{viii}$ is —$CH_3$, and the material is known as Fast Violet B [99-21-8]. When both $R^{viii}$ and $R^{ix}$ are ethoxy, the material is Fast Blue BB [120-00-

3]. U.S. Pat. No. 5,744,429 discloses other aromatic amine compounds, particularly aminoalkylphenothiazines. N-aromatic substituted acid amide compounds, such as those disclosed in U.S. Patent application 2003/0030033 A1 may also be used for the purposes of this invention. Suitable aromatic amines include those in which the amine nitrogen is a substituent on an aromatic carboxyclic compound, that is, the nitrogen is not $sp^2$ hybridized within an aromatic ring.

The aromatic amine will typically have an N—H group capable of condensing with the pendant carbonyl containing group. Certain aromatic amines are commonly used as antioxidants. Of particular importance in that regard are alkylated diphenylamines such as nonyldiphenylamine and dinonyldiphenylamine. To the extent that these materials will condense with the carboxylic functionality of the polymer chain, they are also suitable for use within the present invention. However, it is believed that the two aromatic groups attached to the amine nitrogen may lead to steric hindrance and reduced reactivity. Thus, suitable amines include those having a primary nitrogen atom (—$NH_2$) or a secondary nitrogen atom in which one of the hydrocarbyl substituents is a relatively short chain alkyl group, e.g., methyl. Among such aromatic amines are 4-phenylazoaniline, 4-aminodiphenylamine, 2-aminobenzimidazole, and N,N-dimethylphenylenediamine. Some of these and other aromatic amines may also impart antioxidant performance to the polymers, in addition to dispersancy and other properties.

In one embodiment of the invention, the amine component of the reaction product further comprises an amine having at least two N—H groups capable of condensing with the carboxylic functionality of the polymer. This material is referred to hereinafter as a "linking amine" as it can be employed to link together two of the polymers containing the carboxylic acid functionality. It has been observed that higher molecular weight materials may provide improved performance, and this is one method to increase the material's molecular weight. The linking amine can be either an aliphatic amine or an aromatic amine; if it is an aromatic amine, it is considered to be in addition to and a distinct element from the aromatic amine described above, which typically will have only one condensable or reactive NH group, in order to avoid excessive crosslinking of the polymer chains. Examples of such linking amines include ethylenediamine, phenylenediamine, and 2,4-diaminotoluene; others include propylenediamine, hexamethylenediamine, and other, ω-polymethylenediamines. The amount of reactive functionality on such a linking amine can be reduced, if desired, by reaction with less than a stoichiometric amount of a blocking material such as a hydrocarbyl-substituted succinic anhydride.

In one embodiment the amine comprises nitrogen-containing compounds capable of reacting directly with a polymer backbone. Examples of suitable amines include N-p-diphenylamine, 4-anilinophenyl methacrylamide, 4-anilinophenyl maleimide, 4-anilinophenyl itaconamide, acrylate and methacrylate esters of 4-hydroxydiphenylamine, the reaction product of p-aminodiphenylamine or p-alkylaminodiphenylamine with glycidyl methacrylate, the reaction product of p-aminodiphenylamine with isobutyraldehyde, derivatives of p-hydroxydiphenylamine; derivatives of phenothiazine, vinylogous derivatives of diphenyl amine, or mixtures thereof.

The nitrogen-containing compound may be directly reacted onto the polymer backbone by grafting of the amine onto the polymer backbone either (i) in a solution using a solvent, or (ii) under reactive extrusion conditions in the presence or absence of solvent. The amine-functional monomer may be grafted onto the polymer backbone in multiple ways. In one embodiment, the grafting takes place by a thermal process via an "ene" reaction. In one embodiment the grafting takes place by a Friedel Crafts acylating reaction. In another embodiment the grafting is carried out in solution or solid form through a free radical initiator. Solution grafting is a well-known method for producing grafted polymers. In such a process, reagents are introduced either neat or as solutions in appropriate solvents. The desired polymer product must sometimes then be separated form the reaction solvents and/or impurities by appropriate purification steps.

In one embodiment the nitrogen-containing compound may be directly reacted onto the polymer backbone by free radical catalysed grafting of the polymer in solvents like benzene, t-butyl benzene, toluene, xylene, or hexane. The reaction may be carried out at an elevated temperature in the range of 100° C. to 250° C. or 120° C. to 230° C., or 160° C. to 200° C., e.g., above 160° C., in a solvent, such as a mineral lubricating oil solution containing, e.g., 1 to 50, or 5 to 40 wt. %, based on the initial total oil solution of said polymer and preferably under an inert environment.

The molecular weight of the functionalised polymer will be correspondingly somewhat higher than the ranges given above for the polymer. However, the weight average and number weight molecular weights for functionalised polymer may be readily estimated on the basis of the amount and molecular weight of the amine or alcohol.

Oil of Lubricating Viscosity

The composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include liquid esters of phosphoruscontaining acids (e.g., tricresyl phosphate, trioctyl phosphate, and the diethyl ester of decane phosphonic acid), and polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≦0.03 wt %, and ≧90 wt % saturates, viscosity index 80-120); Group III (sulphur content ≦0.03 wt %, and ≧90 wt % saturates, viscosity index ≧120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group I, Group II, Group III oil or mixtures thereof.

The lubricant composition may be in the form of a concentrate and/or a fully formulated lubricant. If the polymer of the present invention is in the form of a concentrate (which may be combined with additional oil to form, in whole or in part, a finished lubricant), the ratio of the polymer to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives comprise at least one of metal deactivators, conventional detergents (detergents prepared by processes known in the art), dispersants, viscosity modifiers, friction modifiers, antiwear agents, corrosion inhibitors, dispersant viscosity modifiers, extreme pressure agents, antiscuffing agents, antioxidants, foam inhibitors, demulsifiers, pour point depressants, seal swelling agents and mixtures thereof. Typically, fully-formulated lubricating oil will contain one or more of these performance additives.

Dispersants

Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterised by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range 350 to 5000, or 500 to 3000. Succinimide dispersants and their preparation are disclosed, for instance in U.S. Pat. No. 4,234,435. Succinimide dispersants are typically the imide formed from a polyamine, typically a poly (ethyleneamine).

In one embodiment the invention further comprises at least one dispersant derived from polyisobutylene succinimide with number average molecular weight in the range 350 to 5000, or 500 to 3000. The polyisobutylene succinimide may be used alone or in combination with other dispersants.

In one embodiment the invention further comprises at least one dispersant derived from polyisobutylene, an amine and zinc oxide to form a polyisobutylene succinimide complex with zinc. The polyisobutylene succinimide complex with zinc may be used alone or in combination.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulphide, aldehydes, ketones, carboxylic acids, hydrocarbon-substituted succinic anhydrides, maleic anhydride, nitriles, epoxides, phosphorus compounds and/or metal compounds.

The dispersant may be present at 0 wt % to 20 wt %, or 0.1 wt % to 15 wt %, or 0.1 wt % to 10 wt %, or 1 wt % to 6 wt %, or 7 wt % to 12 wt % of the lubricating composition.

Detergents

The lubricant composition optionally further comprises other known neutral or overbased detergents. Suitable detergent substrates include phenates, sulphur containing phenates, sulphonates, salixarates, salicylates, carboxylic acid, phosphorus acid, mono- and/or di-thiophosphoric acid, alkyl phenol, sulphur coupled alkyl phenol compounds, or saligenins. Various overbased detergents and their methods of preparation are described in greater detail in numerous patent publications, including WO2004/096957 and references cited therein.

The detergent may be present at 0 wt % to 10 wt %, or 0.1 wt % to 8 wt %, or 1 wt % to 4 wt %, or greater than 4 to 8 wt %.

Antioxidants

Antioxidant compounds are known and include for example, sulphurised olefins, diphenyl amines, hindered phenols, molybdenum compounds (such as molybdenum dithiocarbamates), and mixtures thereof. Antioxidant compounds may be used alone or in combination. The antioxidant may be present in ranges 0 wt % to 20 wt %, or 0.1 wt % to 10 wt %, or 1 wt % to 5 wt %, of the lubricating composition.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant is an ester and may include, e.g., Irganox™ L-135 from Ciba. A more detailed description of suitable ester-containing hindered phenol antioxidant chemistry is found in U.S. Pat. No. 6,559,105.

Suitable examples of molybdenum dithiocarbamates which may be used as an antioxidant include commercial materials sold under the trade names such as Molyvan 822™ and Molyvan™ A from R. T. Vanderbilt Co., Ltd., and Adeka Sakura-Lube™ S-100, S-165 and S-600 from Asahi Denka Kogyo K. K and mixtures thereof.

Viscosity Modifiers

Although the polymers of the present invention may serve as viscosity modifiers, additional viscosity modifiers of other types may also be present. Such viscosity modifiers are well known materials and include hydrogenated styrene-butadiene rubbers, ethylene-propylene copolymers, hydrogenated styrene-isoprene polymers, hydrogenated radical isoprene polymers, poly(meth)acrylates (often polyalkylmethacrylates), polyalkyl styrenes, polyolefins and esters of maleic anhydride-styrene copolymers, or mixtures thereof. Such additional viscosity modifiers may be present in ranges including 0 wt % to 15 wt %, or 0.1 wt % to 10 wt % or 1 wt % to 5 wt % of the lubricating composition.

Antiwear Agents

The lubricant composition optionally further comprises at least one other antiwear agent. The antiwear agent may be present in ranges including 0 wt % to 15 wt %, or 0.1 wt % to 10 wt % or 1 wt % to 8 wt % of the lubricating composition. Examples of suitable antiwear agents include phosphate esters, sulphurised olefins, sulphur-containing ashless antiwear additives are metal dihydrocarbyldithiophosphates (such as zinc dialkyldithiophosphates), thiocarbamate-containing compounds, such as thiocarbamate esters, thiocarbamate amides, thiocarbamic ethers, alkylene-coupled thiocarbamates, and bis(Salkyldithiocarbamyl) disulphides.

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature of 25° C. to 125° C. U.S. Pat. Nos. 4,758,362 and 4,997,969 describe dithiocarbamate compounds and methods of making them.

Examples of suitable olefins that may be sulphurised to form an the sulphurised olefin include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulphurised olefin includes fatty acids and their esters. The fatty acids are often obtained from vegetable oil or animal oil; and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

In an alternative embodiment, the ashless antiwear agent may be a monoester of a polyol and an aliphatic carboxylic acid, often an acid containing 12 to 24 carbon atoms. Often the monoester of a polyol and an aliphatic carboxylic acid is in the form of a mixture with a sunflower oil or the like, which may be present in the friction modifier mixture include 5 to 95, or in other embodiments 10 to 90, or 20 to 85, or 20 to 80 weight percent of said mixture. The aliphatic carboxylic acids (especially a monocarboxylic acid) which form the esters are those acids typically containing 12 to 24 or 14 to 20 carbon atoms. Examples of carboxylic acids include dodecanoic acid, stearic acid, Laurie acid, behenic acid, and oleic acid.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol. Often the polyol is diethylene glycol, triethylene glycol, glycerol, sorbitol, pentaerythritol or dipentaerythritol.

The commercially available monoester known as "glycerol monooleate" is believed to include 60+5 percent by weight of the chemical species glycerol monooleate, along with 35±5 percent glycerol dioleate, and less than 5 percent trioleate and oleic acid. The amounts of the monoesters, described above, are calculated based on the actual, corrected, amount of polyol monoester present in any such mixture.

Antiscuffing Agents

The lubricant composition may also contain an antiscuffing agent. Antiscuffing agent compounds are believed to decrease adhesive wear are often sulphur-containing compounds. Typically the sulphur-containing compounds include organic sulphides and polysulphides, such as dibenzyldisulphide, bis(chlorobenzyl)disulphide, dibutyl tetrasulphide, ditertiary butyl polysulphide, sulphurised methyl ester of oleic acid, sulphurised alkylphenol, sulphurised dipentene, sulphurised terpene, sulphurised Diels-Alder adducts, alkyl sulphenyl N'N-dialkyl dithiocarbamates, the reaction product of polyamines with polybasic acid esters, chlorobutyl esters of 2,3-dibromopropoxyisobutyric acid, acetoxymethyl esters of dialkyl dithiocarbamic acid and acyloxyalkyl ethers of xanthogenic acids and mixtures thereof.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; organic sulphides and polysulphides such as dibenzyldisulphide, bis(chlorobenzyl)disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; the zinc salts of a phosphorodithioic acid; amine salts of alkyl and dialkylphosphoric acids, including, for example, the amine salt of the reaction product of a dialkyldithiophosphoric acid with propylene oxide; and mixtures thereof.

Other Additives

Other performance additives such as corrosion inhibitors include those described in paragraphs 5 to 8 of US Application US05/038319 (filed on Oct. 25, 2004 McAtee and Boyer as named inventors), octylamine octanoate, condensation products of dodecenyl succinic acid or anhydride and a fatty acid such as oleic acid with a polyamine. In one embodiment the corrosion inhibitors include the Synalox® corrosion inhibitor. The Synalox corrosion inhibitor is typically a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles, dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides; and friction modifiers including fatty acid derivatives such as amines, esters, epoxides, fatty imidazolines, condensation products of carboxylic acids and polyalkylene-polyamines and amine salts of alkylphosphoric acids may also be used in the lubricant composition. Friction modifiers may be present in ranges including 0 wt % to 10 wt % or 0.1 wt % to 8 wt % or 1 wt % to 5 wt % of the lubricating composition.

Industrial Application

The polymer of the invention is suitable for any lubricant composition. The polymer may be employed as a viscosity modifier and/or a dispersant viscosity modifier (often referred to as a DVM).

In one embodiment the polymer of the invention provides at least one of acceptable viscosity modifying performance, acceptable dispersant performance, and acceptable soot and sludge handling. When the polymer of the invention is used in an engine oil lubricant composition, it typically further provides acceptable fuel economy performance or acceptable soot and sludge handling.

In one embodiment for fuel economy performance, the polymer comprises an aromatic amine.

In one embodiment for acceptable soot and sludge handling the polymer comprises a non-aromatic amine.

Examples of a lubricant include an engine oil for a 2-stroke or a 4-stroke internal combustion engine, a gear oil, an automatic transmission oil, a hydraulic fluid, a turbine oil, a metal working fluid or a circulating oil.

In one embodiment the internal combustion engine may be a diesel fuelled engine, a gasoline fuelled engine, a natural gas fuelled engine or a mixed gasoline/alcohol fuelled engine. In one embodiment the internal combustion engine is a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. The phosphorus content may be 0.2 wt % or less, or 0.1 wt % or less, or 0.085 wt % or less, or even 0.06 wt % or less, 0.055 wt % or less, or 0.05 wt % or less. The total sulphated ash content may be 2 wt % or less, or 1.5 wt % or less, or 1.1 wt % or less, or 1 wt % or less, or 0.8 wt % or less, or 0.5 wt % or less.

In one embodiment the lubricating composition is an engine oil, wherein the lubricating composition has a (i) a sulphur content of 0.5 wt % or less, (ii) a phosphorus content of 0.1 wt % or less, and (iii) a sulphated ash content of 1.5 wt % or less.

In one embodiment the lubricating composition is suitable for a 2-stroke or a 4-stroke marine diesel internal combustion engine. In one embodiment the marine diesel combustion engine is a 2-stroke engine. The polymer of the invention may be added to a marine diesel lubricating composition at 0.01 to 20 wt %, or 0.05 to 10 wt %, or 0.1 to 5 wt %.

In several embodiments a suitable lubricating composition comprises additives present on an actives basis in ranges as shown in Table 1a and 1b.

TABLE 1a

| | Embodiments (wt % of lubricant composition) | | | |
|---|---|---|---|---|
| | A | B | C | D |
| Unfunctionalised Polymer | 0.01-50 | 0.1-40 | 0.3-30 | 0.5-20 |
| Other Performance Additives | 0-49 | 0.01-45 | 0.3-30 | 1.5-20 |
| Oil of Lubricating Viscosity | 1-99.99 | 15-99.89 | 40-99.4 | 60-98 |

TABLE 1b

| | Embodiments (wt % of lubricant composition) | | | |
|---|---|---|---|---|
| | A | B | C | D |
| Functionalised Polymer | 0.01-25 | 0.1-20 | 0.3-10 | 0.5-5 |
| Other Performance Additives | 0-49 | 0.01-45 | 0.3-30 | 1.5-20 |
| Oil of Lubricating Viscosity | 26-99.99 | 35-99.89 | 40-99.4 | 45-98 |

The following examples provide an illustration of the invention. These examples are non exhaustive and are not intended to limit the scope of the invention.

EXAMPLES

As used herein below the styrene-butadiene copolymer has a vinyl group content (prior to hydrogenation) on the butadiene blocks of between 40 and 65 mole %.

Styrene-Butadiene Copolymer Functionalised with Maleic Anhydride

A styrene-butadiene copolymer functionalised with maleic anhydride is prepared by the process described below. Hydrogenated styrene-butadiene resin ("SBR") is added to hot (120° C.) t-butylbenzene (10 mL/$g_{SBR}$) in a flange flask with a 5-neck lid (with gasket) and equipped with nitrogen inlet for a nitrogen flow of 470 $cm^3$/min (or 1 SCFH nitrogen), overhead stirrer and stirrer guide, dropping funnel, double walled water condenser and immersion temperature probe with stirring (50 rpm) under nitrogen until dissolved. Maleic anhydride is then added (in an amount suitable to provide the incorporation shown in Table 2; typically 1 g will provide 0.4 g grafted onto the polymer) and stirred (400 rpm) and the mixture is heated to 130° C. The addition funnel is charged with di(t-butyl)peroxide (1:3 molar ratio of initiator to maleic anhydride) in t-butylbenzene (2.5 mL/$g_{SBR}$) and added dropwise to the hot solution over 60 minutes. The reaction is stirred for a further 3 hours and approximately 65-70% of initial solvent is removed gradually under vacuum over 2 hours at 7 to 95 kPa (0.07 to 0.95 bar or 2-28" Hg at 130° C.) and cooled to room temperature. The reaction mixture is treated with toluene (1.25 mL/$g_{SBR}$) and cooled in butanol-$CO_2$ bath (~30 min). The toluene solution is added gradually to cold (−40° C.) methanol:isopropanol (1:1, 2.5 mL/$g_{SBR}$) with constant stirring and the resulting white precipitate is filtered under vacuum and dried on the filter under vacuum for 2 hours. Samples are dried under vacuum at 50° C. until no further weight loss is observed. Specific examples are prepared by using the method described above in combination with the data shown in Table 2. It is noted that lightly crosslinked polymers obtained from reactions involving high initiator charges (e.g. with a target graft of 3 wt % to 5 wt % maleic anhydride (MAA) with 1:2 MAA:initiator ratio) in initial laboratory preparations are slower to dissolve in oil and typically require prolonged mixing and/or heating.

TABLE 2

| Preparative Example | Initiator (mole ratio) | Solvent, Temp (° C.) | SBR conc g/ml | TAN (mg KOH/g) | Wt of MAA on SBR | MAA Graft Efficiency (%) |
|---|---|---|---|---|---|---|
| 1 | 3:1 (MAA:BPO) | PhCl, 115 | 0.037 | 9.18 | 0.80 | 18 |
| 2 | 2:1 (MAA:tBuO2) | PhCl, 130 | 0.043 | 27.42 | 2.38 | 48 |
| 3 | 2:1 (MAA:tBuO2) | tBuPh, 150 | 0.086 | 39.56 | 3.44 | 69 |
| 4 | 2:1 (MAA:tBuO2) | tBuPh, 150 | 0.117 | 20.53 | 1.79 | 36 |
| 5 | 3:1 (MAA:tBuO2) | tBuPh, 130 | 0.080 | 20.11 | 1.76 | 35 |
| 6 | 3:1 (MAA:tBuO2) | tBuPh, 130 | 0.080 | 18.84 | 1.65 | 28 |
| 7 | 2:1 (MAA:tBuO2) | PhCl, 130 | 0.080 | 43.96 | 3.84 | 64 |
| 8 | 2:1 (MAA:tBuO2) | tBuPh, 130 | 0.080 | 13.61 | 1.19 | 40 |
| 9 | 2:1 (MAA:tBuO2) | tBuPh, 130 | 0.083 | 12.06 | 1.05 | 35 |
| 10 | 3:1 (MAA:tBuO2) | tBuPh, 130 | 0.080 | 29.67 | 2.59 | 37 |

Where tBuO2 is tertiary butyl peroxide, tBuPh is tertiary butyl benzene, PhCl is chlorobenzene, SBR is styrene-butadiene copolymer, BPO is benzoyl peroxide, and MAA is maleic anhydride.

Preparative Examples 11 to 20

Amine Functionalised Copolymers le;.5qStyrene-butadiene copolymers functionalised with maleic anhydride (prepared from solution grafting of maleic anhydride) may be further reacted with an amine. The process for preparing an amine-functionalised polymer is described below. Hydrogenated SBR-g-MAA is added to base oil (e.g., Nexbase™ 3050) (89 wt %) heated to 150° C. in a flange flask/five neck lid and gasket, fitted with nitrogen inlet (470 $cm^3$/min, 1 SCFH nitrogen, non subsurface), overhead stirrer, stirrer guide and immersion temperature probe. The polymer-oil solution is heated for minimum 2.5 hours. 4-aminodiphenylamine (ADPA, 1:1, C═O:N) and an amphoteric surfactant (1 wt %) as a slurry in toluene are added over a period of 5 minutes and stirred for a minimum of 18 hours. The vessel is fitted with immersion addition tube and DMAPA (dimethylaminopropyl amine) (1:0.15, C═O:N) in toluene are then added and before stirring for 2 hours. The vessel is equipped for vacuum distillation, and volatile components are distilled at 160° C. and 95 kPa (0.95 bar or 28" Hg). The resultant viscous oil/gel is cooled to 100° C. and transferred whilst hot. Specific Examples are prepared by using the process described above and the information contained in Table 3. In some instances polymers with a higher than expected residual acid/anhydride have poorer oil solubility.

TABLE 3

| Preparative Example | Imidation | Oil (wt %) | Surfactant (wt %) | MAA graft (%) | TBN | TAN |
|---|---|---|---|---|---|---|
| 11 | ADPA | 90 | 0 | 0.80 | — | 0.37 |
| 12 | ADPA | 90 | 0 | 2.38 | 1.2 | 0.69 |
| 13 | ADPA | 90 | 0 | 1.76 | 0.50 | 0.54 |
| 14 | DO3-ADPA (1:1) | 90 | 0 | 1.65 | 0.38 | 2.14 |
| 15 | ADPA | 90 | 0 | 1.19 | 0 | 0.34 |

TABLE 3-continued

| Preparative Example | Imidation | Oil (wt %) | Surfactant (wt %) | MAA graft (%) | TBN | TAN |
|---|---|---|---|---|---|---|
| 16 | ADPA | 89.1 | 1 | 1.05 | 0 | 2.60 |
| 17 | DO3 | 90 | 0 | 1.05 | 0.5 | 0.92 |
| 18 | DO3 | 89.1 | 1 | 1.05 | 1.62 | 3.57 |
| 19 | ADPA | 89 | 1 | 2.59 | 0.55 | 3.19 |
| 20 | ADPA | 90 | 0 | 5.0 | | |

Where ADPA is 4-aminodiphenylamine;
DO3 is disperse orange-3.

Rheology Test

A series of samples prepared above are evaluated in a drain oil rheology test. The samples are analysed using the oscillation rheology test with a TA Instruments AR500™ rheometer in oscillation mode. The test geometry is a 40 mm flat top plate, and the sample is placed directly onto the flat variable temperature peltier plate of the rheometer. The samples are pre-sheared for 30 seconds at a shear stress of 0.080 Pa to ensure that all samples have a similar baseline shear history. The samples are allowed to equilibrate for 5 minutes before the oscillation test is initiated. The samples are equilibrated for a further 1 minute between each temperature step. Sample evaluation is performed with a temperature sweep test at a constant strain of 0.06, covering the temperature range of 40° C. to 150° C. with measurements taken at a total of 30 points. G' is the elastic, or storage modulus, and is defined in more detail in The Rheology Handbook, Thomas G. Mezger (edited by Ulrich Zoll), Published by Vincentz, 2002, ISBN 3-87870-745-2, p. 117. Generally, better results are obtained for samples with a lower G' value. The data obtained is presented in Table 4.

TABLE 4

| Preparative Example | Treat Rate (wt %) | Peak Temp | ΔG' | $G'_{(Max)}$ (Pa) | G' Ratio | ΔG' Ratio |
|---|---|---|---|---|---|---|
| Drain Oil | 0.00 | 100.7 | 3.31 | 3.76 | 1.00 | 1.00 |
| 11 | 0.50 | 119.7 | 1.55 | 2.15 | 0.57 | 0.47 |
| 13 | 0.50 | 89.3 | 3.99 | 4.53 | 0.91 | 0.89 |
| 13 | 1 | 108.3 | 0.41 | 0.96 | 0.19 | 0.09 |
| 16 | 0.50 | 55.2 | 0.22 | 1.50 | 0.40 | 0.07 |
| 16 | 1 | 100.7 | 0.79 | 1.53 | 0.31 | 0.17 |
| 20 | 1 | n/a | ~0 | 1.51 | 0.30 | 0 |

Where
$G'_{(Max)}$ refers to the measurement of the peak G' value exhibited by the sample during the temperature sweep rheology experiment;
ΔG' refers to the measurement of the height of the G' peak obtained during the temperature sweep rheology, by subtracting the G' value of the minimum prior to the peak from the $G'_{max}$ value;
G' ratio refers to a ratio of the $G'_{max}$ of a candidate species to that of the equivalent reference oil to provide a normalised measure of reduction in structure build-up; and
ΔG' Ratio refers to the change in ΔG' between candidate and the equivalent reference oil.

A representative sooted drain oil value has been included as a baseline. The sooted drain oil is analysed prior to each sample to allow G' ratio calculation (ratio of sooted drain oil and sooted oil containing DVM G'(Max) ratio).

The results obtained for the rheology screen test indicate that the polymer of the invention reduces soot structure build-up relative to untreated drain oil.

Lubricating Compositions

The lubricating compositions contain a viscosity modifier (defined by the present invention or a reference comparative example (olefin copolymer)) and an additive package. An additive package containing detergents, dispersants, zinc dialkyldithiophosphates, antioxidants, pour point depressants, friction modifiers, corrosion inhibitors, and compatabilisers is added to lubricant formulations in Table 5.

TABLE 5

| | CE1 | EX1 | CE2 | EX2 | CE3 | EX3 |
|---|---|---|---|---|---|---|
| | Lubricating Compositions (wt %) | | | | | |
| Olefin copolymer (10 wt % in base oil) | 4.0 | — | 8.5 | — | 7.3 | — |
| Styrene Butadiene co-polymer (10 wt % in base oil) | — | 6.0 | — | 14.5 | | 14.0 |
| Oil of lubricating viscosity (base oil 1) | 40.4 | 40.9 | 46.2 | 41.0 | 47.4 | 37.6 |
| Oil of lubricating viscosity (base oil 2) | 44.3 | 42 | 34.0 | 33.3 | 34.0 | 37.6 |
| | Lubricating Composition - Analytical Data | | | | | |
| CCS @ −30° C. | 5670 | 5200 | 6180 | 5540 | 5650 | 5730 |
| KV100 | 9.21 | 8.92 | | 12.97 | 10.79 | 13.7 |
| HTHS | 2.90 | 2.82 | | 3.55 | 3.28 | 3.56 |
| Phosphorus$^{TH}$ (ppm) | 77 | 770 | 770 | 770 | 770 | 750 |
| Sulphur$^{TH}$ (%) | 0.22 | 0.22 | 0.22 | 0.22 | 0.22 | 0.21 |
| Sulphated Ash Content$^{TH}$ (wt %) | 0.78 | 0.78 | 0.78 | 0.78 | 0.78 | 0.76 |
| TBN$^{TH}$ | 7.0 | 7.0 | 7.0 | 7.0 | 7.0 | 6.8 |

Where the superscript$^{TH}$ represents theoretical values for phosphorus and sulphur content; and CE1, CE2 and CE3 are comparative Examples 1 to 3 respectfully.
KV100 is Kinematic Viscosity at 100° C.;
HTHS is high temperature high shear measurement as determined by CEC-L-36-A-90; and
CCS is cold crank simulator viscosity, in centipoise.

Test 1: CEC-L-51-A-98

The lubricant formulations of comparative example 1 and example 1 are both tested in an OM602A engine test. The test procedure is CEC-L-51-A-98 as laid out for the ACEA (European Automobile Manufacturers Association) oil sequences. The results obtained are presented in Table 6.

TABLE 6

| | Specification Requirements | | | | |
|---|---|---|---|---|---|
| Engine OM602A | ACEA C3 limits | MB229.31 | MB229.51 | CE1 | EX1 |
| Average Cam Wear (μm) | ≦45 | ≦45 | ≦45 | 54.8 | 3.7 |
| KV40 Increase (%) | ≦70 | ≦70 | ≦60 | 51.9 | 45.6 |
| Cylinder Wear (μm) | ≦15 | ≦15 | ≦15 | 9.3 | 7.8 |
| Bore Polishing (%) | ≦4.5 | ≦4.5 | ≦3.0 | 1.0 | 1.6 |
| Piston Merit | — | ≧24 | ≧26 | 22.6 | 29.5 |
| Sludge merit | — | ≧8.9 | ≧9.0 | 9.0 | 9.4 |

Where MB229.31 and MB229.51 are Mercedes Benz specifications.

The results of the OM602A engine test indicate that the inclusion of the polymer of the invention into a lubricating composition provides the composition with a lower average cam wear result and improvements in soot, sludge and deposit control.

Test 2: Volkswagon TDi Engine Test

Comparative Example 2 and Example 2 are both evaluated in a Volkswagen™ TDi engine. The test procedure follows the PV1452 and CEC L-78-T-99 methods as laid out in the ACEA oil sequences. Typically it is known that increasing the amount of polymer in a lubricating composition results in reduced piston cleanliness. The results obtained for the test are presented in Table 7.

TABLE 7

| | ACEA C3 Specification Requirements | CE2 | EX2 |
|---|---|---|---|
| Piston Cleanliness (Merit) | — | 61 | 68 |
| Average Ring Stick for 8 rings (ASF) | ≦1.2 | 0 | 0 |
| Maximum Ring Stick ring 1 (ASF) | ≦2.5 | 0 | 0 |
| Maximum Stick ring 2 (ASF) | ≦0.0 | 0 | 0 |

The results demonstrate that the polymer of the invention may be added into a lubricating composition at a higher wt % without having a detrimental affect on piston cleanliness.

Test 3: Peugeot DV4 Engine Test

Comparative Example 3 and Example 3 are run in the Peugeot DV4 as per procedure CEC-L-093 and the ACEA oil sequences. The results obtained are presented in Table 8.

TABLE 8

| Engine Peugeot DV4 | ACEA C3 limits | CE3 | EX3 |
|---|---|---|---|
| Absolute viscosity increase (cSt) | ≦9.2 | 16.4 | 3.37 |

The results indicate that the polymer of the invention in a lubricating composition has acceptable soot control and causes a lower soot related viscosity increase than a comparative example.

Test 4: Panel Coker

A series of lubricating compositions (Examples 4 and 5; and Comparative Examples 4 to 8) are prepared by blending a polymer and other performance additives into an oil of lubricating viscosity. The difference between the Examples and Comparative Examples are (i) the viscosity modfier polymer and (ii) the sulphur, phosphorus and sulphated ash content. Comparative Examples 4 and 7 (CE4 and CE7) have an olefin copolymer viscosity modifer; Comparative Examples 5 and 8 (CE5 and CE8) have a conventional styrene-isoprene polymer; and Examples 4 and 5 (EX4 and EX5) have a styrene-butadiene polymer as defined by the invention. The 'Low SAPS Engine Oil' has a phosphorus content of 0.1 wt % or less, a sulphur content of 0.5 wt % or less and a sulphated ash content of 1.5 wt % or less. The 'High SAPS Engine Oil' has the sulphur, phosphorus and sulphated ash content of greater than 0.1 wt %, greater than 0.5 wt % and greater than 1.5 wt % respectively.

The lubricating compositions are tested in a Panel Coker heated to 325° C., with a sump temperature of 95° C., and a splash/bake cycle of 45 s/45 s. The airflow is 350 ml/min, with a spindle speed of 1000 rpm and the test lasts for 4 hours. The results obtained are presented in Table 9.

TABLE 9

| | High SAPS Engine Oil | | | Low SAPS Engine oil | | |
|---|---|---|---|---|---|---|
| | CE4 | EX4 | CE6 | CE7 | EX5 | CE8 |
| deposits (mg) | 62.7 | 51.7 | 62.3 | 35 | 31.1 | 35 |
| rating | 29 | 32 | 26 | 30 | 43 | 35 |

The results obtained indicate that the polymer of the invention in lubricating compositions with different levels of have improved in high temperature deposit control compared with the Comparative Examples.

Test 5: ASTM D5293

Example 6 and Comparative Example 8 are 5W-30 lubricating compositions and are evaluated using the test method D5293. Both examples contain 8.1 wt % of a performance package (containing dispersants, antioxidants, detergents and antiwear agents) and 0.2 wt % of a pour point depressant. The test determines the low temperature viscometrics. Typically better results are obtained for samples with a lower value for CCS at −30° C. The results obtained are presented in Table 10.

TABLE 10

| | CE8 | EX6 |
|---|---|---|
| Olefin copolymer (10 wt % in base oil) | 9.0 | — |
| Styrene Butadiene copolymer (10 wt % in base oil) | — | 12.0 |
| Base oil 1 | 72.7 | 69.7 |
| Base oil 2 | 10.0 | 10.0 |
| CCS at −30° C. | 4695 | 3449 |
| KV at 100° C. | 10.29 | 10.07 |
| High Temperature High Shear (HTHS), (units Pa s) | 3.08 | 2.88 |
| KV @ 100° C. after shear | 9.33 | 9.86 |

The data obtained indicate that the polymer of the invention in a lubricating composition has better low temperature viscometrics than the comparative Example. Therefore the polymer of the invention in a lubricating composition has acceptable fuel economy.

Lubricating Compositions EX7, CE9 and CE10

Lubricating compositions EX7, CE9 and CE10 all contain a dispersant viscosity modifier derived from functionalising a polymer backbone with maleic anhydride and further reacted with either (a) 4-ADPA (EX7), or (b) a mixture of DO-3 and 3-nitroanaline (CE9 and CE10). The lubricating compositions EX7, CE9 and CE10 further contain an additive package with 3 wt % dispersants, 1.4 wt % detergents, 0.5 wt % antiwear agents. 1.4 wt % antioxidants.

Test 6: Volkswagon PV1452 Test

The lubricating compositions EX7, CE9 and CE10 are evaluated in the Volkswagen™ TDi engine following procedure PV1452 and CEC L-78-T-99 as laid out in the ACEA oil sequences. The results obtained are given in Table

TABLE 11

| | Test duration (Hours) | Test completion | Ring stick |
|---|---|---|---|
| CE9 | 53.5 | Fail | 3.88 |
| CE10 | 43.0 | Fail | 1.38 |
| EX7 | 54 | Pass | 1.70 |

The data obtained indicates that the polymer of the invention in a lubricating composition has acceptable ring stick, gas blowing and oil consumption compared to the Comparative Examples.

Furthermore oils CE9 and EX7 are evaluated in a glass hot tube test. The test involves recirculating a 5 ml sample of oil through a narrow glass tube at 300° C. with an air flow of 10 ml/min for 20 hours. The tubes are rated on a scale 0 to 100 units, with 0 being a black tube and 100 being a clear tube. Typically better results are obtained for samples with a higher rating. The used oil is also tested for viscosity (ASTM D445) and total acid number TAN (ASTM D664). The percentage difference between the starting oil and end of test oil is calculated for the viscosity data. The absolute difference between the starting oil TAN and end of test oil TAN is also calculated. The results obtained are:

TABLE 12

| | CE9 | EX7 |
|---|---|---|
| Hot Tube Rating | 17 | 29 |
| % Change in KV40 ($mm^2/s$) | 91.9 | 76.6 |
| % Change in KV100 ($mm^2/s$) | 10.5 | 5.8 |
| Delta TAN (mgKOH/g) | 21.1 | 14.8 |

Where KV40 is Kinematic Viscosity at 40° C.

The data shows that the polymer of the invention in a lubricating oil composition provides acceptable deposit control, viscosity control and TAN control compared to the comparative example.

Lubricating composition 8 (EX8) and Comparative Example 10 (CE10) contain a viscosity modifier (as defined in Table 13) and an additive package. The additive package contains detergents, dispersants, zinc dialkyldithiophosphates, antioxidants, pour point depressants, friction modifiers, corrosion inhibitors, and compatabilisers. The compositions are presented and characterised in Table 13.

TABLE 13

| | RBO | CE10 | EX8 |
|---|---|---|---|
| | Lubricating Compositions (wt %) | | |
| Additive Package | — | 14.8 | 13.7 |
| Olefin copolymer (12.5 wt % in base oil) | — | 6.1 | — |
| Styrene Butadiene copolymer (10 wt % in base oil) | — | — | 11.3 |
| Oil of lubricating viscosity (base oil 3) | — | 35 | 10 |
| Oil of lubricating viscosity (base oil 4) | — | 44.1 | 65 |

TABLE 13-continued

| | RBO | CE10 | EX8 |
|---|---|---|---|
| | Lubricating Composition - Analytical Data | | |
| CCS @ −30° C. | — | 6130 | 5770 |
| KV100 | — | 11.9 | 12 |
| HTHS | — | 3.68 | 3.5 |
| Phosphorus$^{TH}$ (ppm) | — | 575 | 790 |
| Sulphur$^{TH}$ (%) | — | 0.17 | 0.21 |
| Sulphated Ash Content$^{TH}$ (wt %) | — | 0.6 | 0.64 |

Where RBO is reference Base Oil 5510/1

CE10 and EX8 are tested using Volkswagon PV1481 method to assess deposit tendency in inlet valves and tract of direct injection petrol (i.e., gasoline) engines. The results of the PV1481 method are compared against a reference base oil (5510/1). Typically, better results are obtained for lubricating compositions that have lower deposit accumulations than the reference base oil. The results obtained are:

TABLE 14

| | Laboratory 1 | | Laboratory 2 | |
|---|---|---|---|---|
| | RBO | CE10 | RBO | EX8 |
| Total Deposit for all 8 valves (mg) | 1.310 | 1.440 | 0.662 | 0.411 |
| Average Deposit per valve (mg) | 0.164 | 0.175 | 0.083 | 0.051 |

Note:
that the tests were carried out in different laboratories using the same reference base oil.

The results obtained for EX8 indicate that the polymer of the invention reduces the total amount of deposits in the eight valves of the petrol direct injection engine relative to the reference base oil. In contrast the CE10 results indicate that the olefin copolymer increases the amount of deposits formed. Hence the polymer of the invention has improved deposit control in inlet valves and tract than CE10.

Preparative Examples 21

Amine Functionalised Copolymer from Extrusion

A 5 liter flange flask fitted with nitrogen inlet (250 $cm^3$/min), DeanStark trap with water cooled condenser, overhead stirrer with gland and thermowell/thermocouple is charged with a Group III mineral oil (2000 g). SBR-g-MAA (160 g, 2.19 wt % graft MAA, 35.7 mol anhydride) is added to the oil over 1 hour at 130° C. and stirred for 3 hours. N-Phenyl-p-phenylenediamine (6.58 g, 35.7 mol) is added and the reaction mixture is heated to 150° C. for 16 hours. The reaction mixture is cooled to 130° C. and N,N-dimethylamino propyl amine (0.367 g, 3.57 mol) is added subsurface and the reaction is stirred for 2 hours. The progress of the reaction can be readily monitored by infrared appearance of imide (1708 $cm^{-1}$) and disappearance of anhydride (1781 $cm^{-1}$) peaks is deemed complete by IR and total acid number (very low residual acid value via titration).

The product of preparative example 21 is then mixed with 1 wt % and 2 wt % of surfactant to aid handleability. The surfactants include Surfonics®L24-5 (commercially available from Hunstman Chemical Corporation), Chemsperse®14 (a polyglyceryl-4-oleate surfactant, commercially available from Chemron Corporation), and Amidex®CE (commercially available from Chemron Corporation). The kinematic viscosity data obtained for the product of preparative Example 21 and each surfactant is:

TABLE 15

| | Surfactant | Kinematic Viscosity at 100° C. (KV100), $mm^2/s$ | |
|---|---|---|---|
| | | Surfactant Treat Rate 1 wt % | Surfactant Treat Rate 2 wt % |
| Example 21a | Surfonics ® L24-5 | 945 | 676 |
| Example 21b | Chemsperse ® 14 | 525 | 452 |
| Example 21c | Amidex ® CE | 834 | 372 |

Footnote:
Examples 21a, 21b, and 21c are essentially the same, except the surfactant employed is specified from the table.

The polymer of preparative example 21e.g., example 21a is then further treated with an additional 1.4 wt % of Surfonics®L24-5 and assessed for rheology characteristics as defined in the Rheology Test described above. The product of preparative example 21 has a G' ratio of 0.054 (when treat rate is 0.5 wt %), and 0.006 (when the treat rate is 1 wt %).

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising:

(a) 1 to 99.99 wt % of an oil of lubricating viscosity;

(b) 0.01 to 50 wt % of an unfunctionalised hydrogenated diblock copolymer comprising at least one olefin polymer block (block A) and at least one vinyl aromatic polymer block (block B) with mole ratio of block A/(block A+B) of 0.5 to 0.9, wherein block A contains repeat units with 40 mol % to 65 mol % of branched alkyl groups; and (c) 0 to 49 wt % of a performance additive;

wherein the hydrogenated diblock copolymer comprises a backbone of styrene and butadiene repeat units.

2. The lubricating composition of claim 1, wherein the hydrogenated copolymer has a number average molecular weight of 1000 to 1,000,000.

3. The lubricating composition of claim 1, wherein the hydrogenated copolymer has a polydispersity of 1 to less than 1.6.

4. The lubricating composition of claim 1, wherein the performance additive includes a dispersant, an antioxidant, an antiwear agent, a friction modifier or mixtures thereof.

5. The lubricating composition of claim 1, wherein the lubricating composition is an engine oil, and wherein the composition has at least one of (i) a sulphur content of 0.8 wt % or less, (ii) a phosphorus content of 0.2 wt % or less, or (iii) a sulphated ash content of 2 wt % or less.

6. The lubricating composition of claim 1, wherein the lubricating composition is an engine oil, and wherein the composition has a (i) a sulphur content of 0.5 wt % or less, (ii) a phosphorus content of 0.1 wt % or less, and (iii) a sulphated ash content of 1.5 wt % or less.

7. A method of lubricating a 2-stroke or a 4-stroke marine diesel internal combustion engine comprising supplying thereto the lubricating composition of claim 1.

* * * * *